US006342874B1

(12) United States Patent
Tokunaga et al.

(10) Patent No.: US 6,342,874 B1
(45) Date of Patent: Jan. 29, 2002

(54) PLASMA DISPLAY PANEL OF A SURFACE DISCHARGE TYPE AND A DRIVING METHOD THEREOF

(75) Inventors: Tsutomu Tokunaga; Mitsunori Nozu, both of Yamanashi-ken (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

(21) Appl. No.: 09/050,025

(22) Filed: Mar. 30, 1998

(30) Foreign Application Priority Data

Apr. 2, 1997 (JP) ..... 9-099751

(51) Int. Cl.[7] ..... G09G 3/28
(52) U.S. Cl. ..... 345/68; 345/60
(58) Field of Search ..... 345/60–70; 313/582, 313/584, 586, 590

(56) References Cited

U.S. PATENT DOCUMENTS 5,541,479 A * 7/1996 Nagakubo ..... 313/586
5,661,500 A * 8/1997 Shinoda et al. ..... 345/60
5,838,105 A * 11/1998 Mitomo ..... 313/582
5,952,783 A * 9/1999 Kuroki et al. ..... 313/590
5,952,986 A * 9/1999 Nguyen et al. ..... 345/68
5,977,708 A * 11/1999 Amatsu et al. ..... 313/586
6,018,329 A * 1/2000 Kida et al. ..... 345/60
6,034,657 A * 3/2000 Tokunaga et al. ..... 345/60

* cited by examiner

*Primary Examiner*—Steven Saras
*Assistant Examiner*—Srilakshmi Kumar

(57) ABSTRACT

A plasma display panel has a first sustain electrode and a second sustain electrode, a plurality of address electrodes disposed in a direction perpendicular to the first and second sustain electrodes. Each of the first and second sustain electrodes is formed by a transparent conductive film and a metallic film mounted on the transparent conductive film. A dielectric layer is mounted on the transparent conductive film and the metallic film. The first sustain electrodes and the second sustain electrodes are alternately disposed at every display line. A surface of the dielectric film corresponding to the metallic film is projected from a surface corresponding to other portions.

6 Claims, 5 Drawing Sheets

PLASMA DISPLAY PANEL OF A SURFACE DISCHARGE TYPE AND A DRIVING METHOD THEREOF

BACKGROUND OF THE INVENTION

The present invention relates to a plasma display panel (PDP) of a surface discharge type and a method for driving the PDP.

The surface discharge PDP comprises a plurality of sustain electrodes X and Y. A pair of sustain electrodes X and Y are disposed on a substrate at the same surface thereof corresponding to one display line (row).

A conventional surface discharge PDP comprises a plurality of sustain electrodes X and Y alternately formed in pairs. In such a structure, since the sustain electrodes X and Y adjoin each other, a difference of potential is produced in the line, and a parasitic capacity exists in the line, which causes electric power consumption to increase. In order to prevent unnecessary surface discharge in the line and reduce the parasitic capacity in the line, it is necessary to have a large distance between the electrodes in the line. Such a large distance makes it difficult to obtain high definition of the PDP by reducing a line pitch.

FIG. 4 shows a PDP for solving those problems. A pair of sustain electrodes X and Y are alternately disposed, interposing the discharge gap G so as to alternately change the disposition every display line L. For example, a pair of sustain electrodes X1 and X2 to which the same drive signal is applied are made into one and commonly disposed between the sustain electrodes Y1 and Y2 which are selectively and sequentially driven every display line L. Similarly, a pair of sustain electrodes X3 and X4 are made into one and commonly disposed between the sustain electrodes Y3 and Y4.

Each of the sustain electrodes X and Y comprises a transparent electrode 12 formed by a transparent conductive film and a bus electrode 13 formed by a metallic film layered on the transparent electrode 12 for compensating the conductivity of the transparent electrode 12. The sustain electrodes are covered by a dielectric layer. A plurality of elongated partitions 10*a* are provided in the direction perpendicular to the sustain electrodes.

In a driving operation of the PDP, a unit display period is divided into a reset all at once period, an address period, a discharge sustaining period and a wall charge erasing period as shown in FIG. 5.

In the reset all at once period, reset pulses RPx are applied to the sustain electrodes X1–Xn, and reset pulses RPy are applied to the sustain electrodes Y1–Yn. Thus, the sustain electrodes are excited to discharge at all of the discharge cells for initializing.

In the address period, pixel data pulses DP are applied to the address electrodes by a selecting and writing address method or a selecting and erasing address method. At that time, scanning pulses SP are applied to the sustain electrodes Y. Thus, the wall charge is accumulated on the discharge cell to be lighted every line in order.

In the discharge sustaining period, discharge sustaining pulses IPx and IPy of the same phase are alternately applied to the sustain electrodes X1–Xn, and Y1–Yn for sustaining the discharge and emission of light.

In the wall charge erasing period, wall charge erasing pulses EP are applied to the sustain electrodes.

In such a structure, since a pair of sustain electrodes X are commonly disposed, the number of sustain electrodes X can be reduced half. Thus, the PDP of high definition is obtained. However, the sustain electrodes X are common to the opposite adjoining lines L, and the partitions 10*a* are formed in stripes. Therefore, the discharge expands in upper and lower directions through the sustain electrodes X and transferred to the adjacent discharge cells. Thus, error discharge is liable to occur. Similarly, in the adjacent sustain electrodes Y, if the distance between the electrodes is small, the discharge expands in upper and lower directions, causing error discharge to occur.

In order to prevent the discharge from expanding in upper and lower directions, the partition 10*a* may be formed in a checked pattern to section a discharge space every discharge cell. However, it is very difficult to form a checked partition with high accuracy of good yield.

SUMMARY OF THE INVENTION

An object of the present invention is to provide a plasma display panel of a surface discharge type in which high definition is obtained and quality of display is improved.

According to the present invention, there is provided a plasma display panel of a surface discharge type, including a first substrate at a display side, a second substrate at a backside opposite to the first substrate, interposing a discharge space, a first sustain electrode and a second sustain electrode, interposing a discharge gap at every display line at the display side, a plurality of address electrodes disposed on the second substrate in a direction perpendicular to the first and second sustain electrodes to form a discharge cell at every intersection of the electrodes, each of the first and second sustain electrodes being formed by a transparent conductive film and a metallic film mounted on the transparent conductive film at a position away from the discharge gap, a dielectric layer mounted on the transparent conductive film and the metallic film.

The first sustain electrode and the second sustain electrode are alternately disposed at every display line, the first sustain electrode comprises a pair of elements which are commonly disposed with respect to an adjacent display line, and a surface of the dielectric film corresponding to the metallic film is projected from a surface corresponding to other portions.

A plurality of partitions are provided in each display cell, arranged in an extending direction of the first and second sustain electrodes.

A plurality of projection are provided in each of the display cells opposite to each other, interposing the discharge gap.

Each of the projections has a wide width portion at adjacent the discharge gap, and a small width portion at a base portion thereof.

The present invention further provides a driving method for a plasma display panel of a surface discharge type, the plasma display panel including a first substrate at a display side, a second substrate at a back side opposite to the first substrate, interposing a discharge space, a first sustain electrode and a second sustain electrode, interposing a discharge gap at every display line at the display side, a plurality of address electrodes disposed on the second substrate in a direction perpendicular to the first and second sustain electrodes to form a discharge cell at every intersection of the electrodes, each of the first and second sustain electrodes being formed by a transparent conductive film and a metallic film mounted on the transparent conductive film at a position away from the discharge gap, a dielectric layer mounted on the transparent conductive film and the metallic film.

The method comprises the steps of applying reset pulses to all of the first and second sustain electrodes to discharge all of the discharge cells, thereby forming wall charge in each of the discharge cells, applying pixel data pulses to address electrodes in accordance with display data, lighted pixels and unlighted pixels are selected, alternately applying discharge sustaining pulses to the first and second sustain electrodes for sustaining the lighted pixels and unlighted pixels, each of the reset pulses having a sufficiently longer time constant than the discharge sustaining pulse.

These and other objects and features of the present invention will become more apparent from the following detailed description with reference to the accompanying drawings.

DETAILED DESCRIPTION OF THE PREFERRED EMBODIMENT

Figure 1:
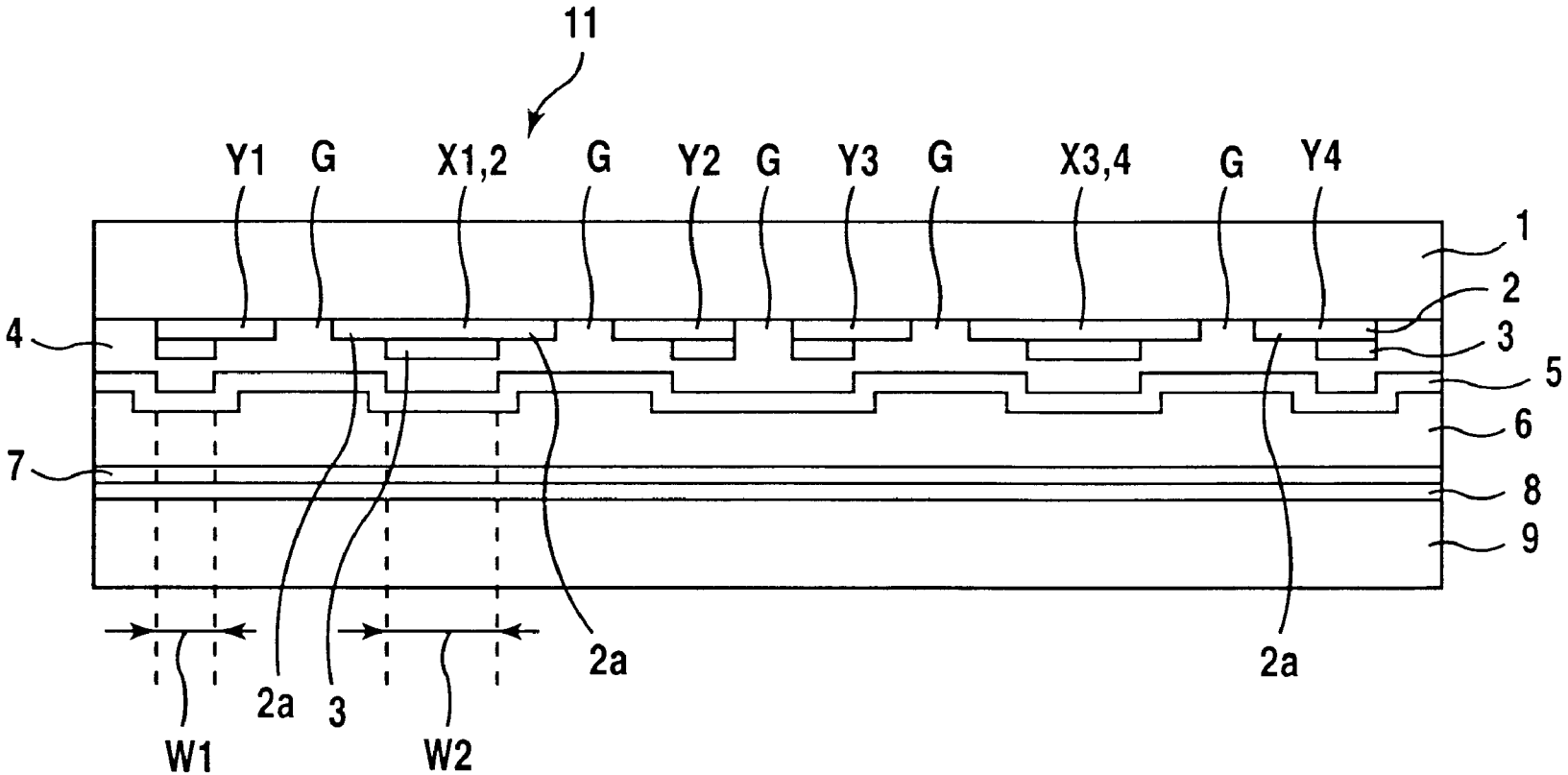
FIG. 1 is a sectional view showing a plasma display panel of a surface discharge type according to the present invention.

Referring to FIG. 1, a PDP 11 of the present invention comprises a pair of substrates 1 and 2 disposed opposite to each other at a display side and at a back side. The substrate 1 as a display portion has a plurality of first and second sustain electrodes X and Y disposed at the inside portion thereof.

A pair of first sustain electrodes X, each comprising element electrodes X1 and X2, and second sustain electrodes Y, each comprising element electrodes Y1 and Y2, are alternately disposed at every display line, interposing the discharge gap G. Namely, the disposition of the first and second sustain electrodes with respect to the discharge gap alternately change at every display line. In addition, a pair of sustain electrodes X1 and X2 to which the same drive signal is applied are made into one and commonly disposed between the sustain electrodes Y1 and Y2 which are selectively and sequentially driven at every display line. Similarly, a pair of sustain electrodes X3 and X4 are made into one and commonly disposed between the sustain electrodes Y3 and Y4.

Each of the sustain electrodes X and Y comprises a transparent electrode 2 formed by a transparent conductive film and a bus electrode 3 formed by a metallic film having a small width and layered on the transparent electrode 2 away from the discharge gap G. The bus electrode 3 of the sustain electrodes X1 and X2 is formed to have a width W2 which is approximately twice as much as a width W1 of the bus electrode 3 of the sustain electrode Y.

The sustain electrodes X and Y are covered by a dielectric layer 4. The dielectric layer 4 is formed so as to be projected at the area corresponding to the width of the bus electrode 3. Namely, at the sustain electrodes X1 and X2, the dielectric layer 4 is projected corresponding to the width W2. Similarly, the dielectric layer 4 is projected at the area corresponding to the width W1 of the bus electrode 3 of each of the sustain electrodes Y1 and Y4. At the sustain electrodes Y2 and Y3, the dielectric layer 4 is projected corresponding to the widths W1 of the respective bus electrodes 3 including a space therebetween.

A protection layer 5 made of MgO is coated on the dielectric layer 4.

Figure 2:
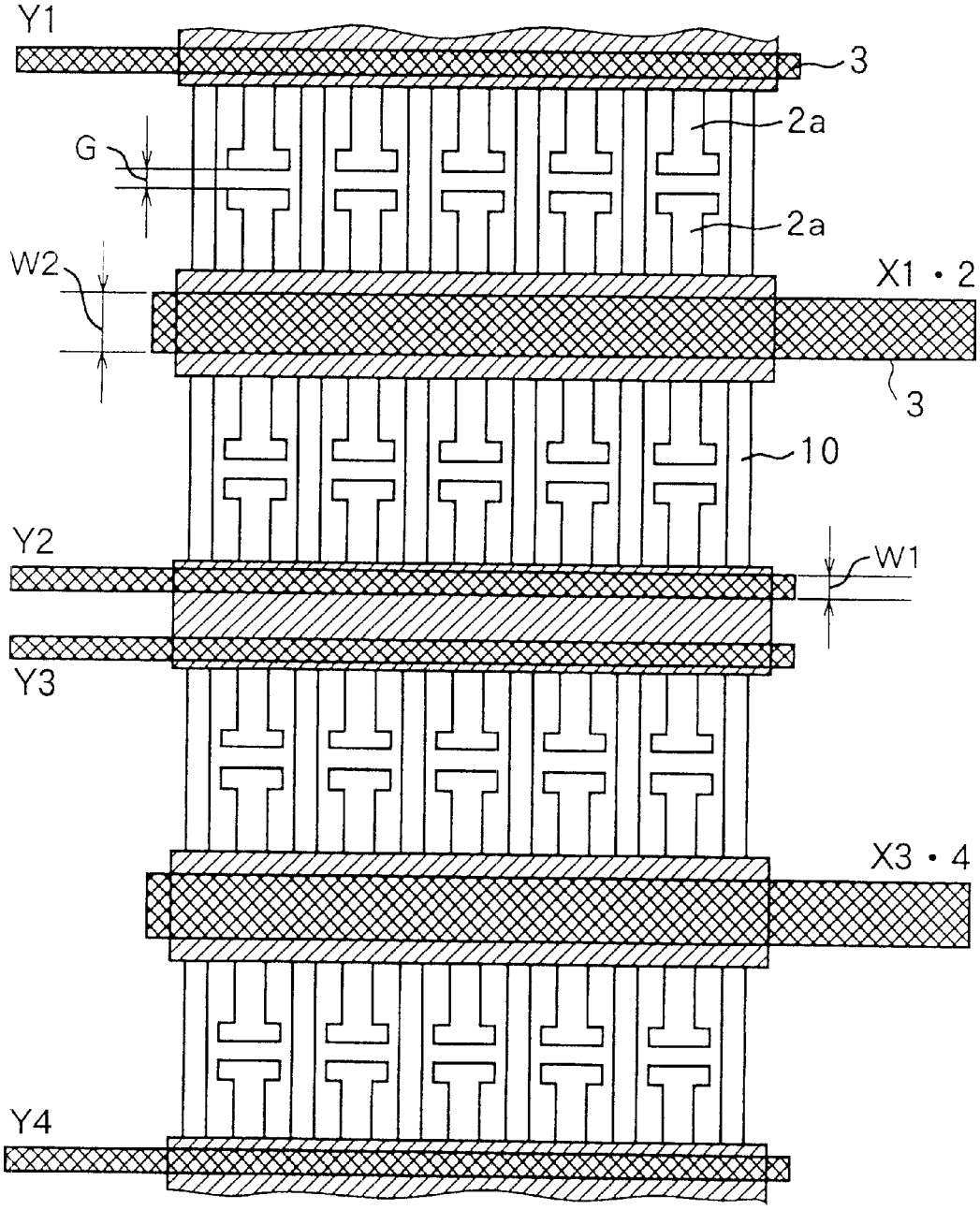
FIG. 2 is a sectional plan view showing the plasma display panel.

Referring to FIG. 2, each of the transparent electrodes 2 of the sustain electrodes X and Y has a plurality of T-shaped projections 2*a* in plane opposite to each other, interposing the discharge gap G. The T-shaped projection 2*a* has a wide width portion at the discharge gap G and a small width portion at the base portion.

In place of the T-shaped projection, the transparent electrode may have a plurality of projections.

Referring back to FIG. 1, on the substrate 9 as a rear member, a plurality of address electrodes 8 are formed to intersect the sustain electrodes X and Y of the substrate 1. Between the address electrodes 8, a plurality of elongated partitions 10 are provided (FIG. 2) for defining a discharge space 6. The partition 10 extends in the direction perpendicular to the sustain electrodes X, Y. A phosphor layer 7 is provided for covering each of the address electrodes 8. The discharge space 6 is filled with rare gases. Thus, a pixel (including a discharge cell) is formed at the intersection of the sustain electrodes X and Y on the substrate 1 and the address electrode 8 on the substrate 9. Since the PDP having a plurality of pixels is formed, it is possible to display images.

Figure 3:
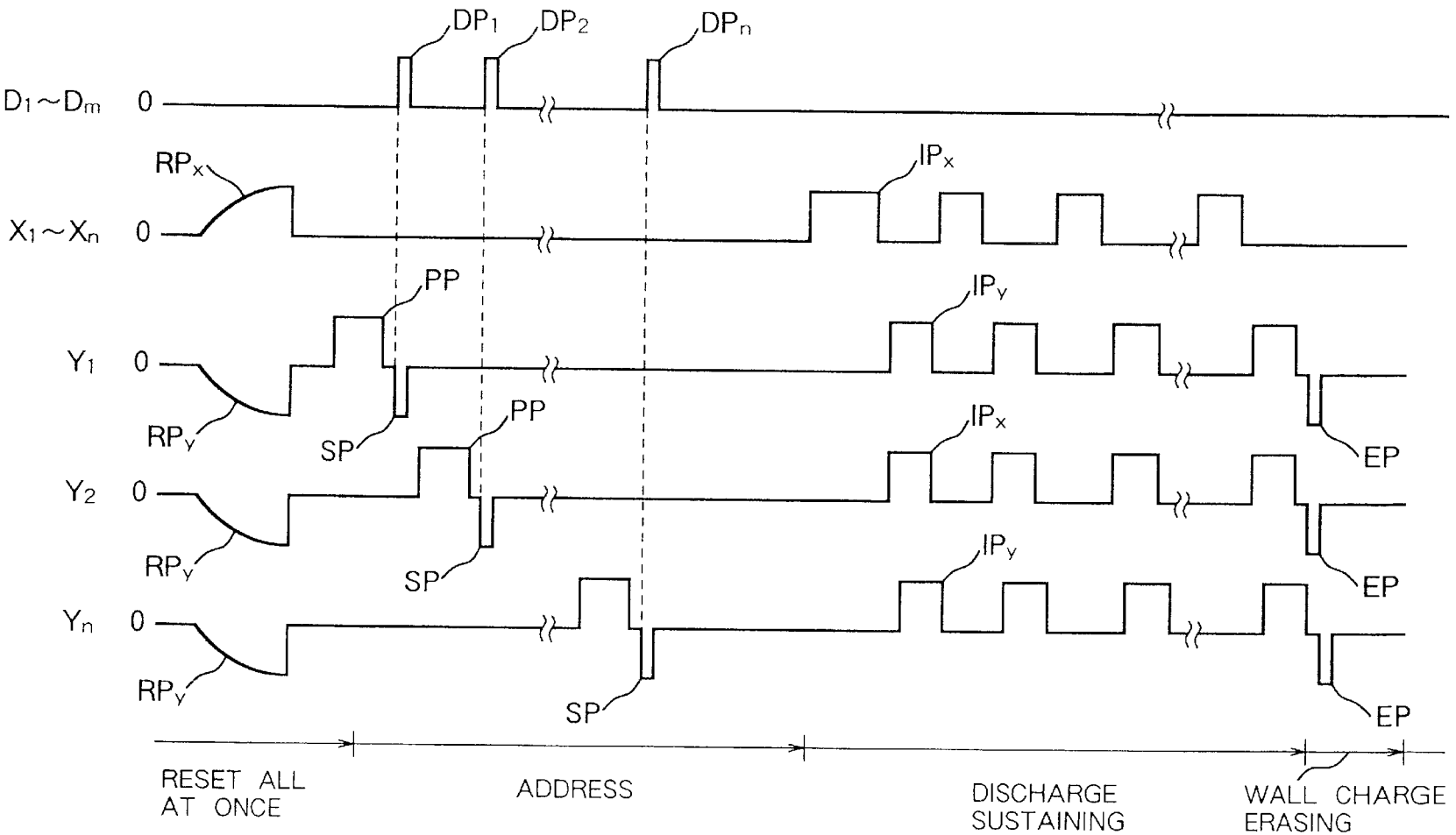
FIG. 3 is time charts showing drive signals for driving the plasma display panel.
Figure 4:
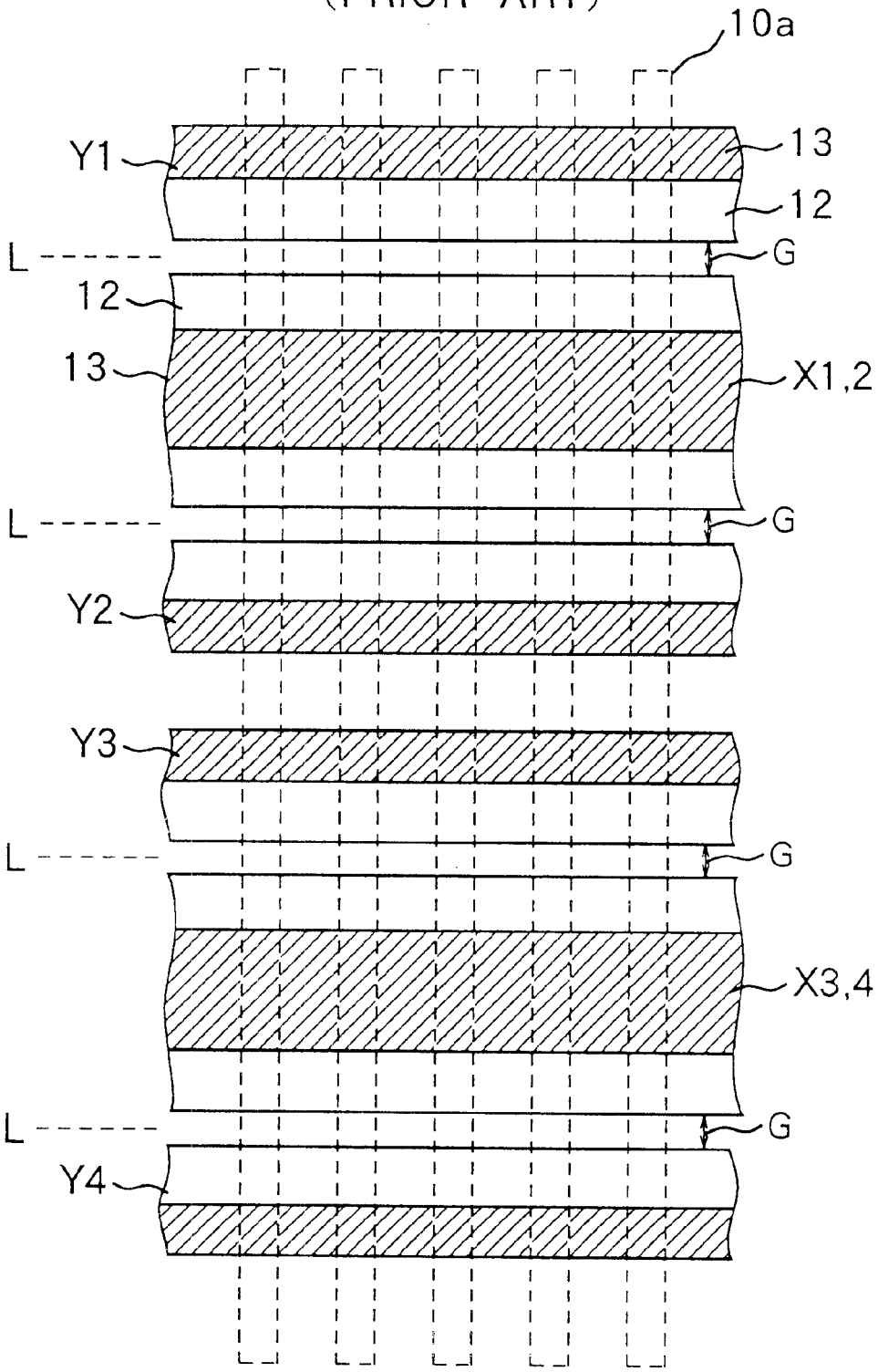
FIG.4 (PRIOR ART)
FIG. 4 is a sectional plan view showing a conventional plasma display panel.
Figure 5:
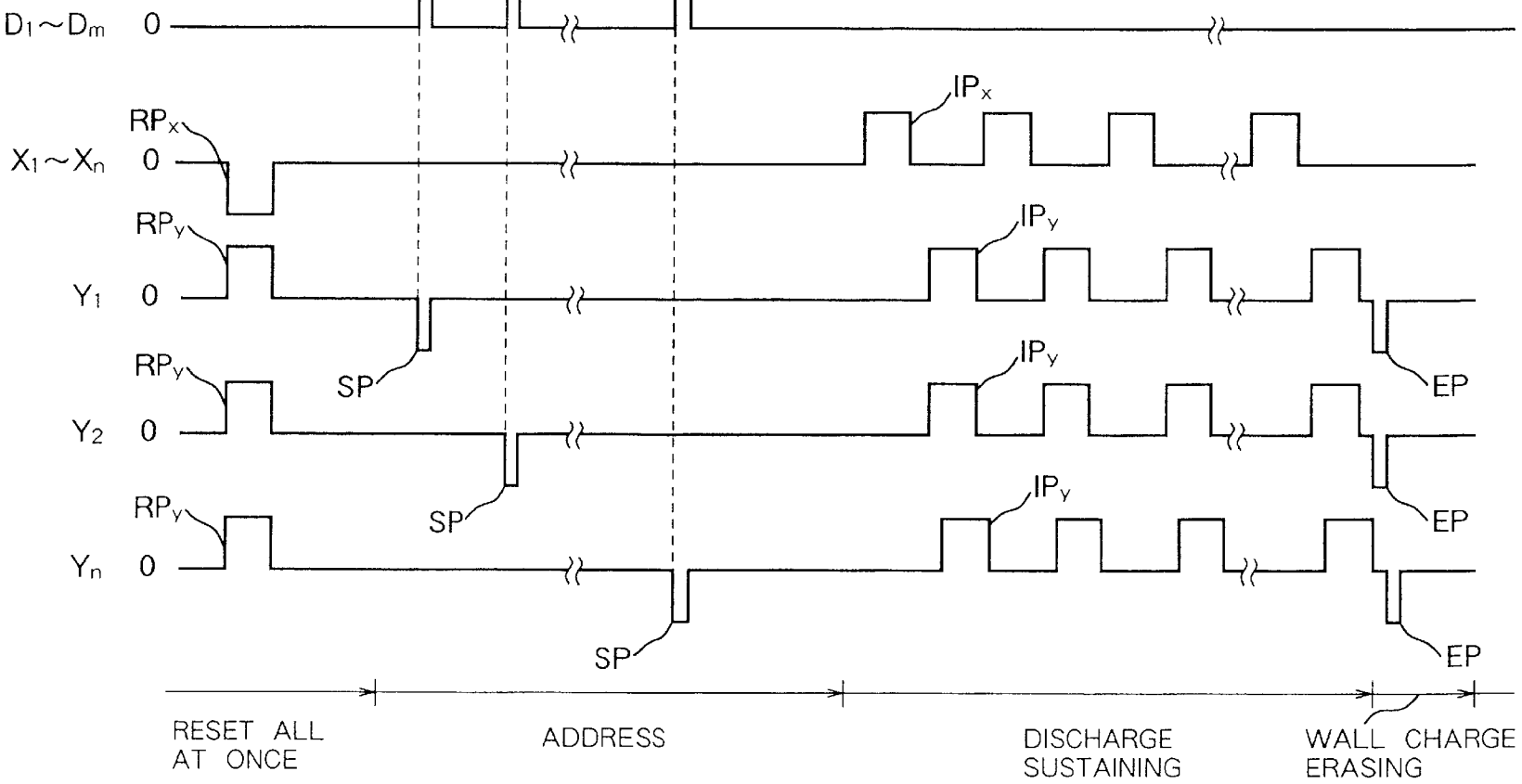
FIG. 5 (PRIOR ART)
FIG. 5 is time charts showing drive signals for the conventional plasma display panel.

Operation of the PDP 11 will be described. FIG. 3 shows a timing chart of drive signals for driving the PDP.

A reset pulse RPx of positive voltage having a long rising time (long time constant) is applied to each of the sustain electrodes X1–Xn. At the same time, a reset pulse RPy of negative voltage having a long rising time is applied to each of the sustain electrodes Y1–Yn. Thus, all of the sustain electrodes in pairs in the PDP 11 are excited to discharge, thereby producing charged particles in the discharge space at the pixel. Thereafter, when the discharge is finished, wall charge is formed and accumulated on the discharge cell (A reset all at once period).

Here, in order to regulate the discharge and emission of light caused by the reset pulse which has no connection with the display and to improve the contrast, the reset pulses RPx and RPy having long rising time (long time constant) are used.

Then, pixel data pulses DP1–DPn corresponding to the pixel data for every row are applied to the pixel data electrodes as address electrodes D1–Dm in order in accordance with display data. At that time, scanning pulses SP are applied to the sustain electrodes Y1–Yn in order in synchronism with the timings of the data pulse DP1–DPn.

At the time, only in the pixel to which the scanning pulse SP and the pixel data pulse DP are simultaneously applied, the discharge occurs, so that the wall charge produced at the reset all at once period is erased.

On the other hand, in the pixel to which only the scanning pulse SP is applied, the discharge does not occur. Thus, the wall charge produced at the reset all at once period is held. Namely, a predetermined amount of the wall charge is selectively erased in accordance with the pixel data (An address period).

Next, a discharge sustaining pulse IPx of positive voltage is applied to the sustain electrodes X1–Xn, and a discharge sustaining pulse IPy of positive voltage is applied to the sustain electrodes Y1–Yn at offset timing from the discharge sustaining pulses IPx. During the discharge sustaining pulses are continuously applied, the pixel which holds the wall charge sustains the discharge and emission of light (A discharge sustaining period).

In the discharge sustaining period, a first pulse of the discharge sustaining pulse IPx is set to have a pulse width wider than the subsequent pulses and the discharge sustaining pulse IPy.

The reason why the first pulse is wide will be described hereinafter.

As aforementioned, when the discharge occurs, the charged priming particles are produced, and the produced charged priming particles reduce as the time passes. As the number of charged particles reduce, the time from the application of the pulse to the start of the discharge (discharge production delay time) becomes long, and the discharge starting time at discharge cells (discharge statistics delay time) becomes uneven. In such a state, when the first pulse of the discharge sustaining pulse is applied, the discharge may not occur. Therefore, even if the subsequent pulses are applied, it is strongly possible not to occur the discharges. Consequently, in the embodiment, the width of the first pulse is set wider than the subsequent pulses. Namely, the width of the first pulse is set larger than the sum of the discharge production delay time, the discharge statistics delay time, and the time necessary to discharge. Therefore, it is possible to ensurely produce the discharge by the first pulse of the discharge sustaining pulse IPx.

Then, wall charge erasing pulses EP are applied to the sustain electrodes Y1–Yn for erasing the wall charges formed on the sustain electrodes. Thus, the wall charges formed on the sustain electrodes X1–Xn and Y1–Yn are erased, whereby the wall charges in the lighted and unlighted pixels are approximately uniformed (A wall charge erasing period).

In the driving method of the PDP, the reset pulse having a gentle waveform at the rise is applied to the sustain electrodes all at once, thereby resetting all at once. In the discharge sustaining period, the pulse width of the first pulse of the discharge sustaining pulse which is applied to the sustain electrodes X1–Xn is set to a large width.

In accordance with the present invention, the first sustain electrodes are commonly disposed, and the dielectric layer is formed to be projected at the bus electrode. Thus, the parasitic capacity is reduced for increasing the starting voltage of discharge, thereby regulating the discharge from expanding in upper and lower directions.

Furthermore, since the reset pulse having long time constant is used to weaken the reset discharge, the discharge can be collected to the central portion of the discharge cell (near the discharge gap). Thus, the contrast is improved, and the expansion of discharge in the upper and lower directions is further regulated. Consequently, high definition is obtained, and the quality of display is improved.

While the invention has been described in conjunction with preferred specific embodiment thereof, it will be understood that this description is intended to illustrate and not limit the scope of the invention, which is defined by the following claims.

What is claimed is:

1. A plasma display panel of a surface discharge type, including a first substrate at a display side, a second substrate at a back side opposite to the first substrate, interposing a discharge space, a first sustain electrode and a second sustain electrode, interposing a discharge gap at every display line at the display side, a plurality of address electrodes disposed on the second substrate in a direction perpendicular to the first and second sustain electrodes to form a discharge cell at every intersection of the electrodes, each of the first and second sustain electrodes being formed by a transparent conductive film and a metallic film mounted on the transparent conductive film at a position away from the discharge gap, a dielectric layer mounted on the transparent conductive film and the metallic film; characterized in that the first sustain electrode and the second sustain electrode are alternately disposed at every display line, the first sustain electrode comprises a pair of elements which are commonly disposed with respect to an adjacent display line, a surface of the dielectric film corresponding to the metallic film is projected from a surface corresponding to other portions.

2. The plasma display panel according to claim 1 wherein opposite transparent conductive films of each pair of the first and second sustain electrodes have a pair of projections in each of the display cells interposing the discharge gap.

3. The plasma display panel according to claim 2 wherein each of the projections has a wide width portion at adjacent the discharge gap, and a small width portion at a base portion thereof.

4. A driving method for a plasma display panel of a surface discharge type, the plasma display panel including a first substrate at a display side, a second substrate at a back side opposite to the first substrate, interposing a discharge space, a first sustain electrode and a second sustain electrode, interposing a discharge gap at every display line at the display side, a plurality of address electrodes disposed on the second substrate in a direction perpendicular to the first and second sustain electrodes to form a discharge cell at every intersection of the electrodes, each of the first and second sustain electrodes being formed by a transparent conductive film and a metallic film mounted on the transparent conductive film at a position away from the discharge gap, a dielectric layer mounted on the transparent conductive film and the metallic film, the steps comprising:

applying reset pulses to all of the first and second sustain electrodes to discharge all of the discharge cells, thereby forming wall charge in each of the discharge cells;

applying pixel data pulses to address electrodes in accordance with display data, lighted pixels and unlighted pixels are selected;

alternately applying discharge sustaining pulses to the first and second sustain electrodes for sustaining the lighted pixels and unlighted pixels, each of the reset pulses having a sufficiently longer time constant than the discharge sustaining pulse.

5. The method according to claim 4 wherein the first sustain electrode and the second sustain electrode are alternately disposed at every display line, the first sustain electrode comprises a pair of elements which are commonly disposed with respect to an adjacent display line, a surface of the dielectric film corresponding to the metallic film is projected from a surface corresponding to other portions.

6. The method according to claim 4 wherein opposite transparent conductive films of each pair of the first and second sustain electrodes have a plurality of projections provided in each of the display cells opposite to each other, interposing the discharge gap.

* * * * *